US005758226A

United States Patent [19]

Motohashi

[11] Patent Number: 5,758,226

[45] Date of Patent: May 26, 1998

[54] IMAGE FORMING APPARATUS AND METHOD IN WHICH A CIRCUMFERENTIAL SPEED OF AN INTERMEDIATE TRANSFER MEMBER IS REDUCED WHEN CHARGING THE INTERMEDIATE TRANSFER MEMBER

[75] Inventor: Toshiaki Motohashi, Sohka, Japan

[73] Assignee: Ricoh Company, Ltd., Tokyo, Japan

[21] Appl. No.: 790,430

[22] Filed: Jan. 29, 1997

[30] Foreign Application Priority Data

Jan. 29, 1996 [JP] Japan ..... 8-013092

[51] Int. Cl.[6] ..... G03G 15/16

[52] U.S. Cl. ..... 399/66; 399/302

[58] Field of Search ..... 399/66, 302, 308

[56] References Cited

U.S. PATENT DOCUMENTS

| | | | |
|---|---|---|---|
| 4,183,658 | 1/1980 | Winthaegen | 399/165 |
| 5,041,878 | 8/1991 | Takai et al. | 399/302 |
| 5,189,478 | 2/1993 | Hara et al. | 399/66 |
| 5,250,999 | 10/1993 | Kimura et al. | 399/39 |
| 5,373,354 | 12/1994 | Tadokoro et al. | 399/45 |
| 5,587,783 | 12/1996 | Nakamura et al. . | |
| 5,640,645 | 6/1997 | Namekata et al. | 399/66 |

FOREIGN PATENT DOCUMENTS

| | | |
|---|---|---|
| 1-149079 | 6/1989 | Japan . |
| 6-194967 | 7/1994 | Japan . |
| 7-140806 | 6/1995 | Japan . |

*Primary Examiner*—Robert Beatty
*Attorney, Agent, or Firm*—Oblon, Spivak, McClelland, Maier & Neustadt, P.C.

[57] ABSTRACT

An image forming apparatus including a charger to charge an intermediate transfer member uniformly after a toner image is transferred from the intermediate transfer member to a transfer sheet or before a toner image is transferred onto the intermediate transfer member from an image carrier, and a controller which, when the intermediate transfer member is being charged with the charger, reduces a circumferential speed of the intermediate transfer member to a speed which is slower than when transferring the toner image from the image carrier to the intermediate transfer member. Nonuniformity of charge on the surface of the intermediate transfer member is eliminated and thereby the occurrence of unsatisfactory transfer of the toner image from the image carrier to the intermediate transfer member is avoided and, consequently, the occurrence of an untransferred streak across an image transferred on a transfer sheet is avoided.

12 Claims, 5 Drawing Sheets

IMAGE FORMING APPARATUS AND METHOD IN WHICH A CIRCUMFERENTIAL SPEED OF AN INTERMEDIATE TRANSFER MEMBER IS REDUCED WHEN CHARGING THE INTERMEDIATE TRANSFER MEMBER

BACKGROUND OF THE INVENTION

1. Field of the Invention

The present invention relates to an image forming apparatus utilizing electrophotography, such as a copying machine, a printer and/or a facsimile machine, and more particularly relates to an image forming apparatus which includes an intermediate transfer member for transferring thereupon a toner image from an image carrier.

This application is based on Japanese Patent Application No. P08-013092 filed on Jan. 29, 1996 and the entire contents of the same application is hereby incorporated by reference.

2. Discussion of the Background

The image forming apparatus utilizing electrophotography generally includes, a drum-shaped photoconductor serving as an image carrier, a charging device for charging the photoconductor , an exposure device for exposing the photoconductor to form a latent image thereupon, a developing device for developing the latent image to a visible toner image and a first transfer device for transferring the toner image formed on the photoconductor onto an intermediate transfer belt with medium electrical resistance. The transfer belt serves as an intermediate transfer member which is provided between the photoconductor and the first transfer device. A corona charger as a second transfer device for transferring the toner image on the intermediate transfer belt to a transfer sheet is provided near the intermediate transfer belt, and the transfer sheet passes between the corona charger and the intermediate transfer belt so that the toner image is transferred onto the transfer sheet from the intermediate transfer belt.

Operations for forming an image include a charging operation to charge the photoconductor with the charging device, an exposure operation to expose the photoconductor with the exposure device in accordance with image information, a developing operation to develop an exposed part of the photoconductor with toner to a visible toner image by means of the developing device, a first transfer operation to transfer the toner image on the photoconductor to the intermediate transfer belt by applying to the first transfer device a voltage with a polarity opposite to that of the toner image and a second transfer operation to transfer the toner image on the intermediate transfer belt to a transfer sheet by applying to the corona charger as the second transfer device a voltage with a polarity opposite to that of the toner image on the intermediate transfer belt.

When forming a full-color image, toner images of different colors are formed on the photoconductor and are transferred sequentially onto the intermediate transfer belt, superimposing one after another to form a full-color toner image and then such a full-color toner image on the intermediate transfer belt is transferred onto a transfer sheet.

As the intermediate transfer belt, generally a medium resistance belt with a volume resistivity of $1\times10^{8-1012}$ Ω-cm and a surface resistivity of $1\times10^{8}$–$10^{11}$ Ω (JISK6911) is used because, if a high resistance belt is used, a charged potential of the intermediate transfer belt rises due to a bias voltage applied thereto repeatedly as the first transfer operation is repeated, which consequently causes improper transfer in the first and second transfer operations. If a medium resistance belt is used as the intermediate transfer belt and the belt is discharged via its support member, the charged potential of the intermediate transfer belt is kept to substantially the same level even when the first transfer operation is repeated for forming a full-color toner image, and such improper transfer will not occur.

When the transfer sheet is conveyed to a transfer position between the intermediate transfer belt and the corona charger for transferring thereupon the full-color toner image from the intermediate transfer belt, a leading edge of the conveyed sheet is guided by an entrance guide of the corona charger so as to be conveyed between the corona charger and the intermediate transfer belt and then the leading edge of the sheet contacts the intermediate transfer belt. The transfer sheet, when conveyed further, is bent by electrostatic force generated by a transfer current applied to the corona charger so as to stick the transfer sheet to the surface of the intermediate transfer belt starting from the leading edge through the end.

However, because there is a gap between a tip end of the entrance guide and the intermediate transfer belt, the leading edge of the transfer sheet is in an unstable state after passing through the entrance guide and before contacting the intermediate transfer belt. This causes unsatisfactory contact between the leading edge of the transfer sheet and the intermediate transfer belt, resulting in unsatisfactory transfer of the toner image from the intermediate transfer belt to the transfer sheet, which consequently produces an unsatisfactory image having a so-called transfer hollow.

For solving the above-mentioned unsatisfactory transfer problem, there is proposed in Tokugan-hei No.7-118087 a technology to control a transfer current for improving contact between the leading edge of a transfer sheet and an intermediate transfer belt.

The proposed technology is to apply to a corona charger as a second transfer device, when the leading edge of a transfer sheet reaches a transfer electric field, a transfer current which is larger than a normal transfer current applied when transferring the toner image to the middle part of the transfer sheet. Such a larger current continues to be applied until the leading edge of the transfer sheet contacts the intermediate transfer belt, and then the current is lowered to the normal level.

However, with the above-mentioned technology, because the current applied by the corona charger to the part of the intermediate transfer belt contacting the leading edge of the transfer sheet is larger than that applied at other parts of the intermediate transfer belt, excessive charge remains at the surface of such parts of the intermediate transfer belt. Namely, the residual charge on some parts of the surface of the intermediate transfer belt is higher than that on other parts. If an image forming operation is performed with this condition, when transferring a toner image from the image carrier to the intermediate transfer belt, unsatisfactory transfer is caused at the part of the intermediate transfer belt where relatively high residual charge remains, producing as a result an untransferred streak across the image transferred onto the transfer sheet.

SUMMARY OF THE INVENTION

The present invention has been made in view of the aforementioned problem and accordingly an object of the present invention is to provide an image forming apparatus which eliminates nonuniformity of charge on the surface of an intermediate transfer member before a toner image is transferred from an image carrier to the intermediate transfer member and a method for forming an image including a step for eliminating such nonuniformity of charge on the surface of the intermediate transfer member.

In order to achieve the above-mentioned object, an image forming apparatus according to the present invention is provided with a charger to charge the intermediate transfer member uniformly before the toner image is transferred thereupon from the image carrier or after the toner image is transferred from the intermediate transfer member to a transfer sheet, and a controller which, when the intermediate transfer member is being charged with the charger, slows down the circumferential speed of the intermediate transfer member to a speed which is slower than when transferring the toner image from the image carrier to the intermediate transfer member.

In a preferred embodiment, when the intermediate transfer member is being charged with the charger the circumferential speed of the intermediate transfer member is slowed down to about one half of the circumferential speed of the intermediate transfer member at a time of transferring the toner image from the image carrier to the intermediate transfer member.

Further, in order to achieve the above-mentioned object, a method for forming an image according to the present invention includes a step of slowing down the circumferential speed of the intermediate transfer member to a speed slower than when transferring a toner image from an image carrier to the intermediate transfer member at a same time when a step of charging the intermediate transfer member starts or after the step of charging the intermediate transfer member starts.

With the present invention, occurrence of unsatisfactory transfer of the toner image from the image carrier to the intermediate transfer member is avoided and the consequent production of an untransferred streak across the transferred image on a transfer sheet is prevented.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
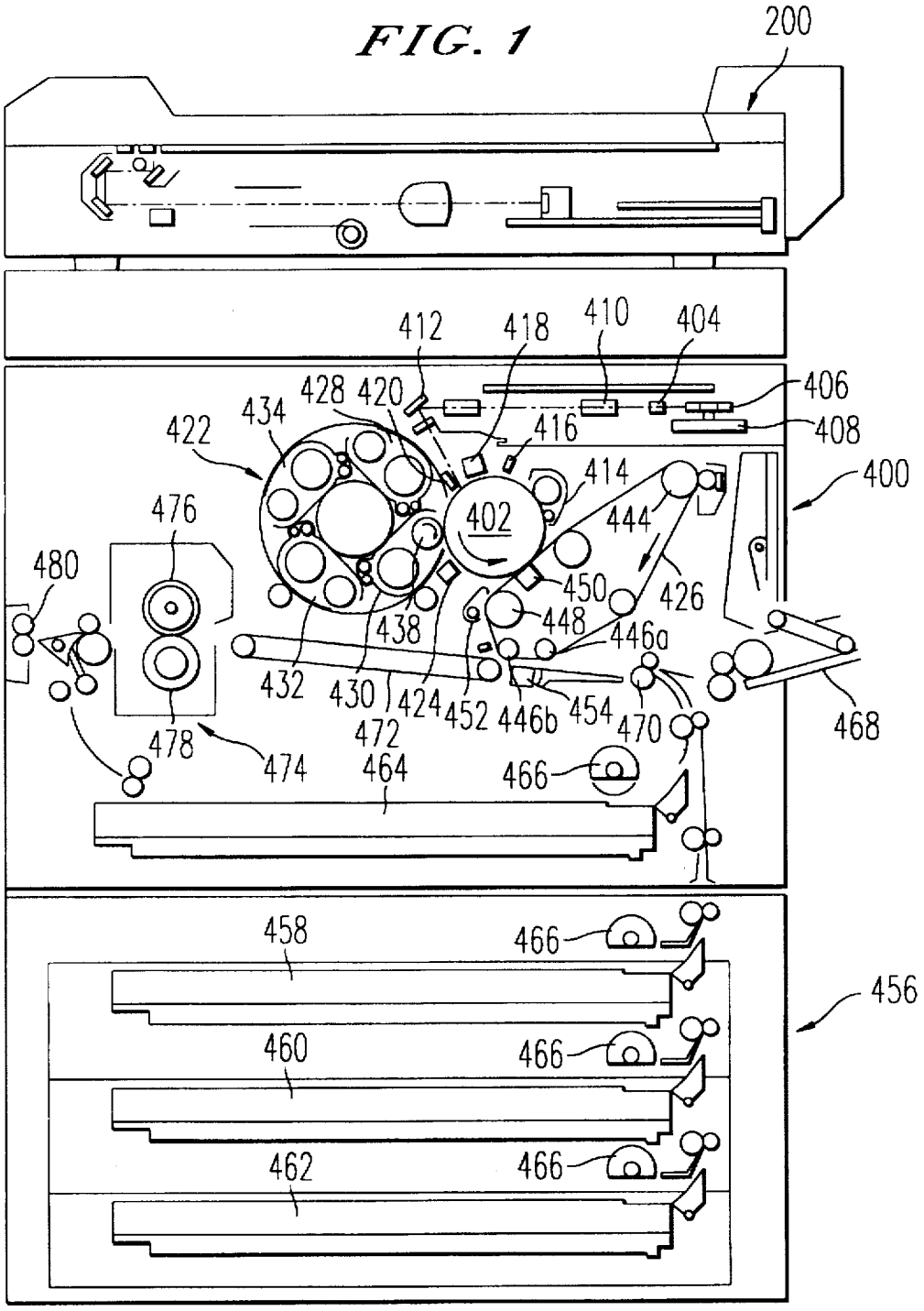
FIG. 1 is a schematic drawing illustrating the overall structure of an image forming apparatus including an intermediate transfer belt.

Referring now to the drawings, wherein like reference numerals designate identical or corresponding parts throughout the several views, embodiments of the present invention are next explained.

Figure 2:
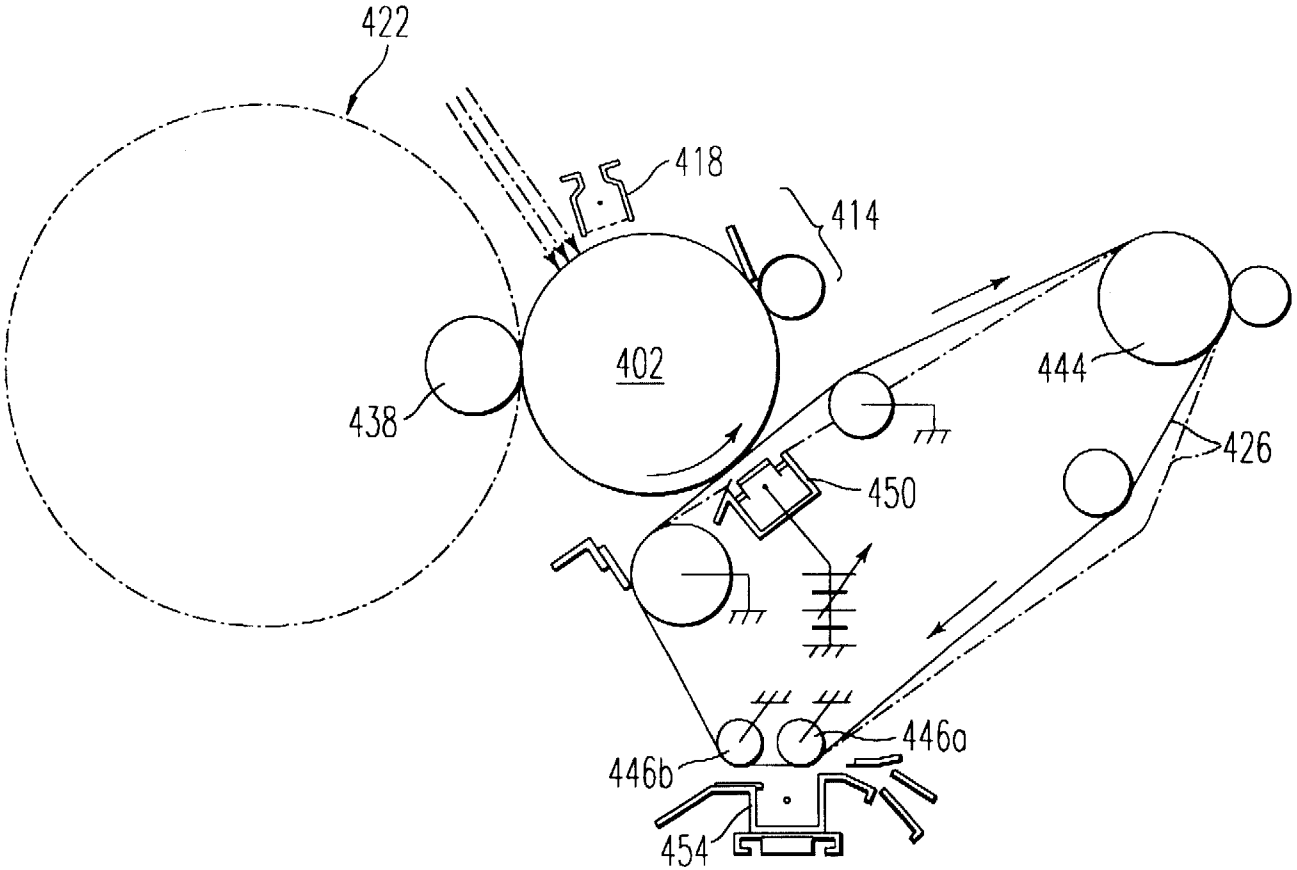
FIG. 2 is a schematic drawing illustrating a main part of the apparatus of FIG. 1.

FIG. 1 is a schematic drawing illustrating an overall structure of an image forming apparatus including an intermediate transfer belt and FIG. 2 is a schematic drawing illustrating a main part of the apparatus.

In these drawings, a color scanner 200, reads an original image and converts the image to an electric signal of corresponding color image data for each separate color. Then, an optical writing unit 400 (as an exposure device) converts the color image data from the color scanner to an optical signal and then optically writes the original image to form a latent image on a photoconductor 402 which functions as an image carrier.

The optical writing unit 400 includes a laser emitting device 404 such as a laser diode and a controller (not shown) for controlling light emission of the device 404, a polygon mirror 406 and a motor 408 for rotating the mirror 406, a fθ lens 410 and a reflective mirror 412.

The photoconductor 402 rotates in a counterclockwise direction as indicated by an arrow in FIG. 1. Around the photoconductor 402, there are arranged a photoconductor cleaning unit 414, a discharge lamp 416, an electric potential sensor 420, a selected developing unit (a developing unit 438 in FIG. 1) of a revolving developing apparatus 422 as a developing device, a developing density pattern detector 424, and an intermediate transfer belt 426 as an intermediate transfer member.

As a material of the intermediate transfer belt 426, a medium resistance material with a volume resistivity of $1\times10^{8}$–$10^{12}$ Ω-cm and a surface resistivity $1\times10^{8}$–$10^{11}$ Ω (JISK6911), such as for example ethylene/tetrafluoroethylene (ETFE) or epichlorohydrin rubber, is used. The intermediate transfer member may be shaped in a drum-shape instead of a belt-shape.

The revolving developing apparatus 422 includes a black developing unit 428, a cyan developing unit 430, a magenta developing unit 432, a yellow developing unit 434 and a developing device drive unit (not shown) to rotate each of the developing units. Each developing unit includes a developing sleeve which rotates while keeping an ear or spike of developer in contact with a surface of the photoconductor 402 for developing a latent image formed thereupon and a developer agitating paddle which rotates for pumping up and agitating the developer.

When the apparatus is in a waiting state the revolving developing apparatus 422 is set with the black developing unit 428 at a developing position, and when an image forming operation starts the scanner 200 starts to read black color image data of an original placed upon the scanner 200 with a prescribed timing, and in accordance with this image data, optical writing by means of a laser light starts to form a corresponding latent image, or charge pattern, on the photoconductor 402. Herein, a latent image of black color image data is called a black latent image, and a latent image of cyan, magenta and yellow is referred to in the same manner.

For developing the black latent image starting from its leading edge, the black developing sleeve starts to rotate before the leading edge of the black latent image reaches the developing position, and then the black latent image starts to be developed with the black toner. The development of the black latent image continues until the trailing edge of the black latent image reaches the developing position. When the trailing edge of the black latent image passes through the developing position, the revolving developing apparatus 422 immediately starts to rotate and continues to rotate until a developing unit for a next color comes to the developing position. This should be completed no later than when the leading edge of a latent image for the next color reaches the developing position.

When the image forming operation is commenced as described above, first the photoconductor 402 is rotated in a counterclockwise direction as indicated by an arrow in FIG. 2, and the intermediate transfer belt 426 is rotated in a clockwise direction. With the rotation of the photoconductor 402, a black toner image, a cyan toner image, a magenta toner image and a yellow toner image are formed in sequence on the photoconductor 402, and the images are then transferred in sequence onto the intermediate transfer belt 426, being superimposed one after another to form, finally, a full color toner image on the intermediate transfer belt 426.

As explained below in more detail, the black toner image is formed in the following manner.

The charger 418 charges the photoconductor 402 through corona charging uniformly at about −700 V with negative charge. Then, the laser diode 404 performs raster exposure in accordance with the black image signal from the scanner 200. When the raster exposure is performed, an exposed part of the photoconductor 402 initially charged uniformly loses its charge proportionally to the quantity of exposure light to form a black latent image on the photoconductor 402.

Toner in the revolving developing apparatus 422 is charged with a negative polarity due to agitation with ferrite carrier mixed with the toner in the developing apparatus 422, and further bias voltage in the form of negative d.c. voltage superimposed with a.c. voltage is applied to the black developing sleeve of the revolving developing apparatus 422 from a developing bias electric source (not shown) so that the developing sleeve is biased relative to a metal base layer of the photoconductor 402.

Therefore, when the negative-charged black toner on the black developing sleeve touches the photoconductor 402, the black toner does not adhere to portions of the photoconductor 402 where the negative charge remains, while the black toner does adhere to the exposed portions where no charge remains, so that a black toner image corresponding to the black latent image is formed.

Figure 3:
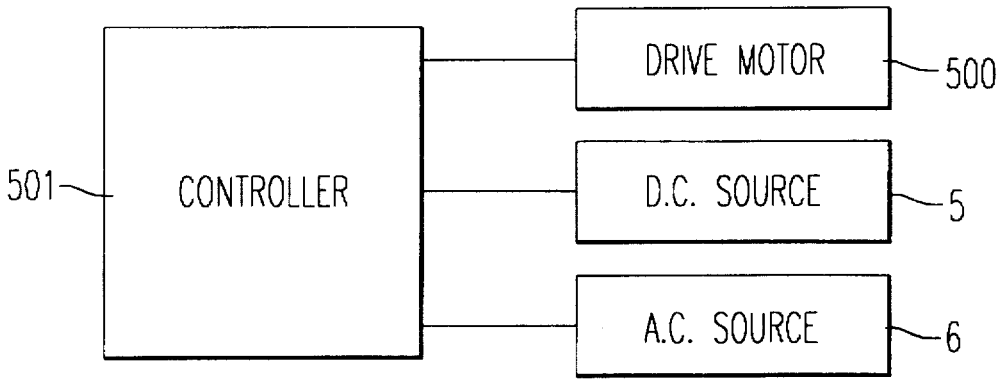
FIG. 3 is a block diagram illustrating a control part of the apparatus of the present invention.

The intermediate transfer belt 426 is extended around and supported by a drive roller 444, a pair of transfer opposed rollers 446*a*, 446*b*, a cleaning opposed roller 448 and a group of compliance rollers, and its driving operation is controlled by a drive motor 500 under control of a controller 501, both shown in FIG. 3.

The black toner image formed on the photoconductor 402 is transferred by means of a belt corona charger 450 as a first transfer device onto the surface of the intermediate transfer belt 426 which is rotated in contact with the photoconductor 402. Hereinafter, the transfer of the toner image from the photoconductor 402 onto the intermediate transfer belt 426 is referred to as a first transfer. The charging efficiency of the belt corona charger 450 is about 20–40%.

Non-transferred toner remaining on the photoconductor 402 is cleaned off by the photoconductor cleaning unit 414 for subsequent use of the photoconductor 402 and the recovered toner is carried via a recovery pipe and stored in a discharge toner tank (not shown).

Subsequent to the formation of the black toner image, a process of forming a cyan toner image is initiated. Specifically, the scanner 200 starts reading of cyan image data of the original at a given timing and formation of a cyan latent image is performed by laser light writing based on the cyan image data.

The revolving developing apparatus 422 rotates after the trailing edge of the black toner image passes the developing position and before the leading edge of the cyan latent image reaches the developing position, so that the cyan developing device is set at the developing position to develop the cyan latent image with cyan toner.

Subsequently, development of the cyan latent image is performed, and after the trailing edge of the cyan latent image passes the developing position and before the leading edge of a magenta latent image reaches the developing position the revolving developing apparatus 422 rotates again to move the magenta developing device to the developing position.

As for the operations of reading image data, formation of a latent image and development of the latent image for magenta and yellow, explanation is omitted because they are the same as for black and cyan.

On the intermediate transfer belt 426, the black, cyan, magenta and yellow toner images are transferred in sequence with their positions aligned correctly on the same plane so as to form a four-color superimposed toner image, and then the superimposed toner image is transferred onto a transfer sheet serving as a recording medium by the transfer corona charger 454 used as a second transfer device.

In a transfer sheet cassette 464 within a main body of the apparatus and in transfer sheet cassettes 458, 460, 462 in a transfer sheet bank 456, transfer sheets of various sizes are stored. From a transfer sheet cassette containing sheets of a selected size, a transfer sheet is fed and carried toward a pair of registering rollers 470 via a feed roller 466. Numeral 468 in FIG. 1 denotes a manual feed tray for feeding manually a transparency sheet, a thick sheet, or the like.

When an image forming operation is started, a transfer sheet is fed from one of the transfer sheet cassettes or the manual feed tray 468, and then waits at a nipping part of the pair of registering rollers 470. The pair of registering rollers 470 are driven so as to register the leading edge of the carried transfer sheet with the leading edge of the toner image when the leading edge of the toner image on the intermediate transfer belt 426 reaches the corona charger 454, so as to achieve registration between the transfer sheet and the toner image.

When the transfer sheet superimposed with the intermediate transfer belt 426 passes over the corona charger 454, which serves as the second transfer device, the transfer sheet is charged with positive charge by a corona discharging current and most of the toner image is transferred onto the transfer sheet. Subsequently, when the transfer sheet passes through a discharging brush (not shown) provided at a left side of the corona charger 454 in FIG. 1, the transfer sheet is charge-neutralized and is separated from the intermediate transfer belt 426 to move to a sheet conveying belt 472.

The transfer sheet with the four-color superimposed toner image transferred thereupon from the intermediate transfer belt 426 is conveyed by the sheet conveying belt 472 to a fixing unit 474 where the toner image is melted and fixed at a pinching portion between a fixing roller 476 controlled at a given temperature and a pressure roller 478. Then, the transfer sheet is conveyed out of the apparatus by a pair of exiting rollers 480 and is stacked on a copy tray (not shown) with the surface carrying the image facing upward, thus achieving a full color copy.

After the transfer of the toner image to the intermediate transfer belt 426, the surface of the photoconductor 402 is cleaned by the photoconductor cleaning unit 414, which may comprise a brush roller or a rubber blade, and is then discharged uniformly by the discharge lamp 416.

Likewise, after transferring the toner image to the transfer sheet, the surface of the intermediate transfer belt 426 is cleaned by pressing a cleaning blade of the cleaning unit 452 onto the surface of the belt 426 using a blade driving mechanism.

In a case of repeating copying, subsequent to the image forming process of the fourth color of a first copy, the operations of the color scanner 200 and the image formation onto the photoconductor 402 advance to an image forming operation of a first color of a second copy with a given timing. As for the intermediate transfer belt 426, subsequent to the transfer process of the four-color superimposed toner image onto the transfer sheet for the first copy, the surface of the intermediate transfer belt 426 is charged uniformly with the corona charger 454 as described later more in detail and then a black toner image for the second copy is transferred from the photoconductor 402 to the intermediate transfer belt 426 on a region cleaned by the cleaning unit 452. Subsequently, the same operations as for the first copy are performed in the same manner.

Figure 4:
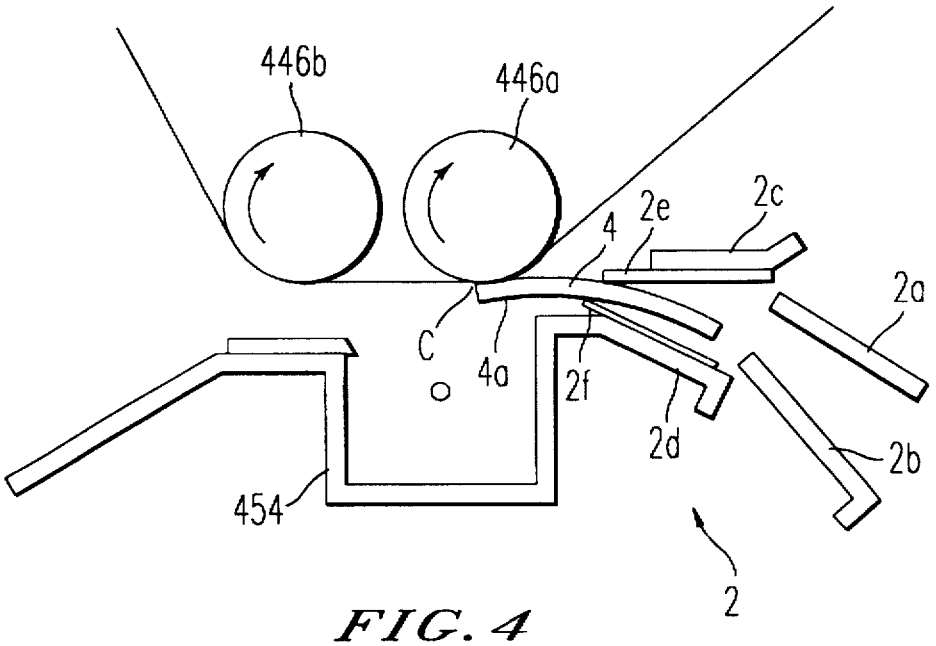
FIG. 4 is a schematic drawing illustrating a transfer area of the apparatus of the present invention and further illustrating a state in which a leading edge of a transfer sheet is in contact with a surface of the intermediate transfer belt.

FIG. 4 is a schematic drawing illustrating a transfer area of the apparatus, further illustrating a state in which the leading edge of a transfer sheet 4 is in contact with the surface of the intermediate transfer belt 426.

In FIG. 4, numerals 446*a* and 446*b* denote transfer opposed rollers supporting the intermediate transfer belt 426 facing the corona charger 454, and numeral 2 denotes a guide member to guide the transfer sheet 4. The guide member 2 includes guide pieces 2*a*–2*f* constituting an entrance guide. Guide pieces 2*a* and 2*b*, and 2*c* and 2*d* face with each other respectively, and a guide piece 2*e* and a guide piece 2*f* which are made of thin resin plates guide the transfer sheet 4 toward the corona charger 454. The guide piece 2*e* is fixed to the guide piece 2*c* and is placed at an upper position and the guide piece 2*f* is fixed to the guide member 2*d* as a part of a case of the corona charger 454 and is placed at a lower position. These guide pieces 2*e* and 2*f* face with each other and are arranged so that a space in-between becomes narrow in the transfer sheet travel direction. The conveyed transfer sheet 4 is directed towards the transfer opposed roller 446*a*by this arrangement.

Figure 5:
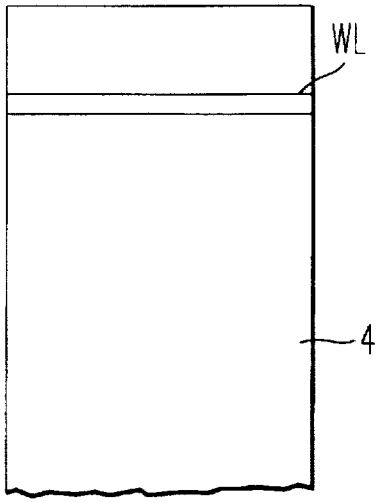
FIG. 5 is a schematic drawing illustrating an untransferred streak produced on a transferred image on a transfer sheet.

As described earlier, in the apparatus wherein a transfer current which is larger than a normal transfer current is applied for adhering the leading edge of a transfer sheet to an intermediate transfer belt for achieving satisfactory transfer of a toner image from the intermediate transfer belt onto the transfer sheet, an electric potential of a contact portion C of the intermediate transfer belt 426 which contacts with the leading edge 4*a* of the transfer sheet 4 as shown in FIG. 4 becomes higher than the electric potential of the other portions of the intermediate transfer belt 426. As a result, excessive charge remains at the surface of such a portion of the intermediate transfer belt 426, and consequently unsatisfactory transfer of the toner image occurs at that portion of the intermediate transfer belt 426 when transferring a toner image from the photoconductor 402 to the intermediate transfer belt 426. Consequently, as shown in FIG. 5, an untransferred streak WL is produced across the transferred image on the transfer sheet 4 at a position corresponding to the portion of the intermediate transfer belt 426 where the leading edge 4*a* of the transfer sheet 4 has contacted it and relatively high residual charge remains.

In this embodiment, therefore, the corona charger 454 is used as a charging device to charge the intermediate transfer belt 426 uniformly after a toner image is transferred from the intermediate transfer belt 426 to a transfer sheet or before a toner image is transferred from the photoconductor 402 to the intermediate transfer belt 426. Namely, the corona charger 454, which is provided as the second transfer device for transferring a toner image from the intermediate transfer belt 426 to a transfer sheet, is also used as the charging device for charging the intermediate transfer belt 426.

Figure 6:
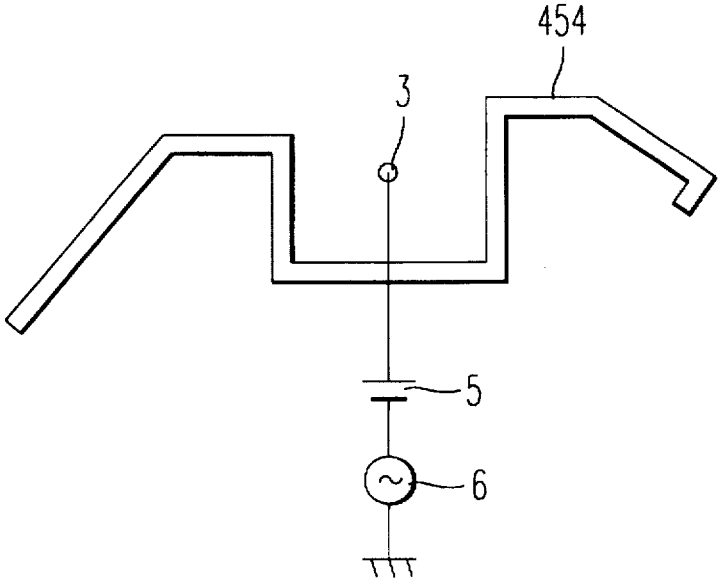
FIG. 6 is a schematic drawing illustrating a corona charger.
Figure 7:
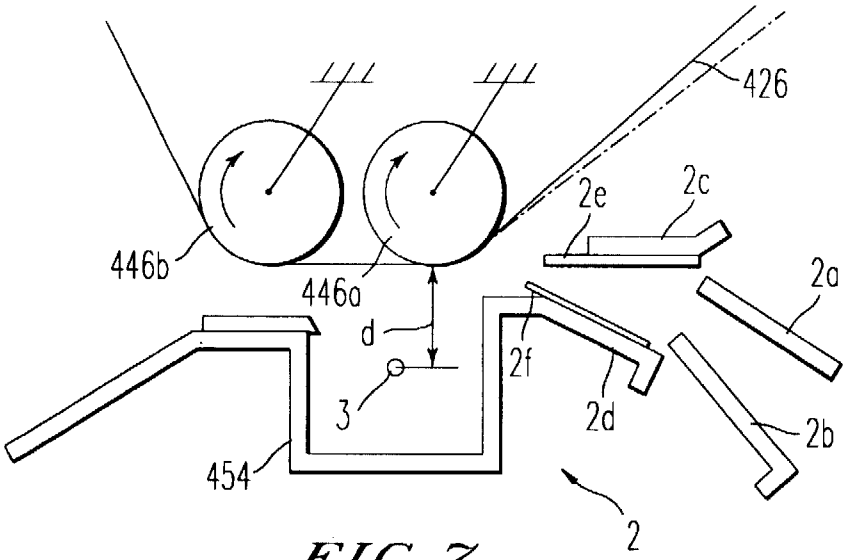
FIG. 7 is a schematic drawing illustrating the transfer area of the apparatus of the present invention and illustrating a distance between a charging wire of the corona charger and the intermediate transfer belt.

FIG. 6 is a schematic drawing illustrating the corona charger 454 in this embodiment and as shown in the drawing a charging wire 3 of the corona charger 454 is connected to a high voltage d.c. source 5 and a high voltage a.c. source 6. Further, a distance d between the charging wire 3 of the corona charger 454 and the intermediate transfer belt 426, which is shown in FIG. 7, is set to 9 mm, and a voltage in the range from 4 KV to 7 KV is applied to the wire 3 with a current controlled at +100 μA when charging the intermediate transfer belt 426.

Further, the apparatus is so constructed that when the corona charger 454 charges the intermediate transfer belt 426, the controller 501 shown in FIG. 3 controls the driving of the drive motor 500 to slow down the circumferential speed of the intermediate transfer belt 426.

With such a construction, when the corona charger 454 charges the intermediate transfer belt 426, a.c. high voltage of 6 KV at 500 Hz superimposed with d.c. high voltage of 5 KV is applied to the charging wire 3 and further the circumferential speed of the intermediate transfer belt 426 is slowed down to 52.5 mm/sec, which is one half of the normal circumferential speed of the intermediate transfer belt 426 at the time of transferring a toner image from the photoconductor 402 to the intermediate transfer belt 426. Now, the surface potential of the intermediate transfer belt 426 has been charged uniformly to 250 V and consequently an image with satisfactory image quality will be obtained. Charging conditions are not limited to the above-mentioned conditions. For example, a d.c. high voltage alone may be applied to the charging wire 3 instead of applying d.c. high voltage superimposed with a.c. high voltage.

To elaborate, when the start of an image forming 5 operation is initiated, the photoconductor 402 starts to rotate and at the same time the corona charger 454 is turned on. Also, the intermediate transfer belt 426 starts to be driven by the drive motor 500 to rotate at the same time when the corona charger 454 is turned on or shortly after the corona charger 454 is turned on. The circumferential speed of the intermediate transfer belt 426 at that time is controlled by the controller 501 to be 52.5 mm/sec, which is one half of the circumferential speed of the intermediate transfer belt 426 at the time of transferring thereupon a toner image from the photoconductor 402. Then, before the toner image on the photoconductor 402 reaches the transfer nip position where the photoconductor 402 and the intermediate transfer belt 426 contact each other, the circumferential speed of the intermediate transfer belt 426 is speeded up to the speed for transferring the toner image from the photoconductor 402 to the intermediate transfer belt 426. The controller 501 starts to count when the writing of the image on the photoconductor 402 starts, and when it detects that the count reaches a predetermined value which corresponds to a position immediately preceding the above-mentioned transfer position, the controller 501 controls the drive motor 500 to increase the circumferential speed of the intermediate transfer belt 426. After the circumferential speed of the intermediate transfer belt 426 is increased to the normal speed for transferring a toner image from the photoconductor 402 to the intermediate transfer belt 426, the toner image of the first color is transferred onto the intermediate transfer belt 426 from the photoconductor 402. Each toner image of the second, third and fourth colors is formed and transferred from the photoconductor 402 to the intermediate transfer belt 426 sequentially superimposing one after another on the belt 426. After a four-color superimposed toner image is formed on the intermediate transfer belt 426, the four-color toner image is transferred to the transfer sheet 4 with-the help of charging the transfer sheet with the corona charger 454.

After the transfer of the four-color superimposed toner image to the transfer sheet 4 from the intermediate transfer belt 426, the circumferential speed of the intermediate transfer belt 426 is decreased and the corona charger 454 charges the intermediate transfer belt 426. The circumferential speed of the intermediate transfer belt 426 is slowed down by control of the drive motor 500 when the controller 501 detects that the trailing edge of the transfer sheet 4 passes the transfer nip position.

If the charging of the intermediate transfer belt 426 is performed after transferring the toner image from the intermediate transfer belt 426 to the transfer sheet as described above, then, when an image forming operation for a next copy is started, additional charging of the intermediate transfer belt 426, before transferring a toner image of the first color for the next copy from the photoconductor 402 to the intermediate transfer belt 426, may not be necessary.

Figure 8:
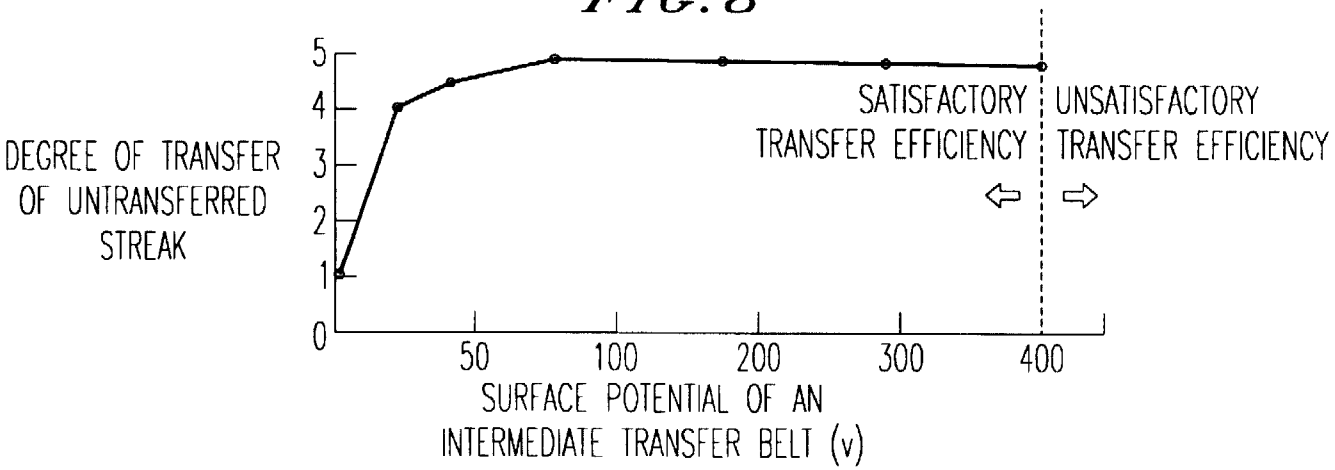
FIG. 8 is a graph illustrating a relation between the surface potential of the intermediate transfer belt and a degree of transfer of the untransferred streak on an image on a transfer sheet.

FIG. 8 is a graph illustrating a relation between the surface potential of the intermediate transfer belt 426 and the degree of transfer of an untransferred streak WL produced on a transferred image on a transfer sheet 4, the horizontal axis being the surface potential of the intermediate transfer belt 426 and the vertical axis being the degree of transfer of the streak WL. A full degree of transfer, indicated by the number 5, is the degree where no untransferred streak WL appears.

As shown in FIG. 8, if the surface potential of the intermediate transfer belt 426 exceeds 400 V, even if nonuniformity of charge is eliminated, the charge can not removed completely by a grounding member connected to the intermediate transfer belt 426 such as a grounding roller or the like before the transfer operation of transferring the toner image to the intermediate transfer belt 426 from the photoconductor 402 is performed. In other words, relatively high residual charge remains on the entire surface of the intermediate transfer belt 426, and therefore, transfer of the toner image from the photoconductor 402 to the intermediate transfer belt 426 is not performed adequately, consequently resulting in an unsatisfactory image on the transfer sheet.

On the other hand, if the surface potential of the intermediate transfer belt 426 is below 20 V, nonuniformity of charge is not eliminated and a relatively high level of residual charge remains on the portion of the intermediate transfer belt 426 where the leading edge of the transfer sheet 4 has contacted it and high current has been applied for achieving satisfactory contact between the transfer sheet and the intermediate transfer belt 426, and consequently transfer of the toner image from the photoconductor 402 to the intermediate transfer belt 426 is not performed adequately at this portion. Consequently, an untransferred streak WL is produced across the transferred image on the transfer sheet 4.

Therefore, it is preferable that the surface potential of the intermediate transfer member is uniformly charged at a voltage in the range from 20 V to 400 V.

In the above-mentioned embodiment, the invention is explained for the case that nonuniformity of charge on the intermediate transfer member is caused by application of relatively high transfer current to the intermediate transfer member for achieving adhesion of the leading edge of a transfer sheet to the surface of the intermediate transfer member. However, application of the invention is not limited to such a case only, and the present invention can be applied to any cases where nonuniformity of charge occurs on the surface of the intermediate transfer member, regardless of the causes of the occurrence.

Further, although the above-mentioned embodiment is explained with the intermediate transfer belt 426 as the intermediate transfer member, a drum-shaped intermediate transfer drum may also be used.

Still further, although the transfer corona charger 454, which is the transfer device for transferring a toner image onto the intermediate transfer belt 426 to a transfer sheet, is also used as the charging device for charging the intermediate transfer belt 426 in the embodiment, a separate charger may be provided at a position facing the intermediate transfer belt 426 between the transfer position for transferring the toner image from the intermediate transfer belt 426 to a transfer sheet and the transfer position for transferring the toner image from the photoconductor 402 to the intermediate transfer belt 426.

Furthermore, although the corona charger 454 is used as the transfer device in the embodiment, if the separate charger is provided beside the transfer device, contact types of transfer device such as a transfer roller, a transfer brush, a transfer blade or the like which contact the intermediate transfer belt 426 for transferring the image may also be used.

This invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An image forming apparatus comprising:

an image carrier;

a developing unit which supplies toner to a latent image formed on the image carrier to develop the latent image to a visible toner image;

an intermediate transfer member to transfer thereupon the toner image from the image carrier;

a charger to charge the intermediate transfer member uniformly before the toner image is transferred thereupon from the image carrier; and a controller which, when the intermediate transfer member is being charged with the charger, reduces a circumferential speed of the intermediate transfer member to a speed slower than when transferring the toner image from the image carrier to the intermediate transfer member.

2. The image forming apparatus according to claim 1, wherein said controller, when the intermediate transfer member is being charged with the charger, reduces the circumferential speed of the intermediate transfer member to about one half of a circumferential speed of the intermediate transfer member at a time of transferring the toner image from the image carrier to the intermediate transfer member.

3. The image forming apparatus according to claim 1, wherein said charger uniformly charges a surface potential of the intermediate transfer member to a voltage in the range from 20 V to 400 V.

4. The image forming apparatus according to claim 1, wherein the charger is a transfer device for transferring the toner image from the intermediate transfer member to a transfer sheet.

5. The image forming apparatus according to claim 1, wherein the charger charges the intermediate transfer member uniformly after the toner image is transferred from the intermediate transfer member to the transfer sheet.

6. An image forming apparatus comprising:

an image carrier;

a developing unit which supplies toner to a latent image formed on the image carrier to develop the latent image to a visible toner image;

an intermediate transfer member on which the toner image from the image carrier is transferred;

a charger which charges the intermediate transfer member uniformly after the toner image is transferred from the intermediate transfer member to a transfer sheet; and a controller which, when the intermediate transfer member is being charged with the charger, reduces a circumferential speed of the intermediate transfer member to a speed slower than when transferring the toner image from the image carrier to the intermediate transfer member.

7. The image forming apparatus according to claim 6, wherein said controller, when the intermediate transfer member is being charged with the charger, reduces the circumferential speed of the intermediate transfer member to about one half of a circumferential speed of the intermediate transfer member at a time of transferring the toner image from the image carrier to the intermediate transfer member.

8. The image forming apparatus according to claim 6, wherein said charger uniformly charges a surface potential of the intermediate transfer member to a voltage in the range from 20 V to 400 V.

9. The image forming apparatus according to claim 6, wherein the charger is a transfer device for transferring the toner image from the intermediate transfer member to the transfer sheet.

10. A method for forming an image, comprising:

starting an image forming operation;

starting charging of an intermediate transfer member with a charger after the step of starting the image forming operation;

reducing a circumferential speed of the intermediate transfer member to a speed slower than a speed for transferring a toner image from an image carrier to the intermediate transfer member at a same time as, or after, when the step of charging the intermediate transfer member starts;

speeding up the circumferential speed of the intermediate transfer member to the speed for transferring the toner image from the image carrier to the intermediate transfer member before the toner image is transferred from the image carrier to the intermediate transfer member;

transferring the toner image from the image carrier to the intermediate transfer member; and transferring the toner image from the intermediate transfer member to a transfer sheet.

11. The method for forming an image according to claim 10, further comprising reducing the circumferential speed of the intermediate transfer member and charging the intermediate transfer member with the charger, after the step of transferring the toner image from the intermediate transfer member to the transfer sheet.

12. A method of forming an image, comprising:

transferring a toner image from an image carrier to an intermediate transfer member;

transferring the toner image from the intermediate transfer member to a transfer sheet;

reducing a circumferential speed of the intermediate transfer member to a speed slower than a speed for transferring the toner image from the image carrier to the intermediate transfer member; and charging the intermediate transfer member uniformly with a charger, after the toner image is transferred from the intermediate transfer member to the transfer sheet.

* * * * *